United States Patent [19]

Yellin

[11] 3,955,863

[45] May 11, 1976

[54] MEANS FOR CONVERTING AN OPEN-SHELVED UNIT OR ETAGERE TO A CLOSED CABINET WITH SLIDABLE CLOSURE PANELS

[76] Inventor: Bernard Yellin, 5252 S. Kolmar Ave., Chicago, Ill. 60632

[22] Filed: Nov. 7, 1974

[21] Appl. No.: 521,683

[52] U.S. Cl. ..... 312/257 R; 312/108; 312/111

[51] Int. Cl.[2] ..... A47B 43/00; F16B 12/00

[58] Field of Search ..... 312/257 R, 257 SK, 257 A, 312/111, 107, 108

[56] References Cited

UNITED STATES PATENTS

| | | | |
|---|---|---|---|
| 1,517,299 | 12/1924 | Lehman | 312/257 R |
| 1,897,568 | 2/1933 | Bales | 312/257 R |
| 2,962,334 | 11/1960 | Dutmers | 312/108 |
| 3,053,558 | 9/1962 | Challas, Jr. et al. | 312/111 |
| 3,125,385 | 3/1964 | Friedman | 312/107 |
| 3,525,560 | 8/1970 | Gasner et al. | 312/257 R |
| 3,583,780 | 6/1971 | Berkowitz | 312/108 |
| 3,664,274 | 5/1972 | Bustos | 312/108 |

FOREIGN PATENTS OR APPLICATIONS

| | | | |
|---|---|---|---|
| 1,150,069 | 1/1958 | France | 312/257 SK |
| 864,911 | 4/1961 | United Kingdom | 312/257 R |

*Primary Examiner*—Paul R. Gilliam
*Assistant Examiner*—Victor N. Sakran
*Attorney, Agent, or Firm*—Max R. Kraus

[57] ABSTRACT

Means for converting an open shelved unit or etagere to a closed cabinet with slidable closure panels and end panels, the open shelved unit comprising top and bottom members and spaced upright members which are detachably secured to the corners of said spaced top and bottom members to form an open shelved unit or etagere, the top and bottom of said unit which serve as shelves being molded of a plastic material in the same or identical mold cavity, with all of the upright members also being identical and being molded in the same or identical cavity; the invention herein comprising the means for converting said open shelved unit or etagere to a closed cabinet with slidable front and rear closure panels and with end panels, the said means for each unit comprising a pair of plastic molded frame-like members which are molded in the same or identical mold cavity with one of said frame-like members positioned on the bottom shelf and the other frame-like member positioned on the underside of the top shelf and inverted in respect to the bottom frame-like member, each of said pair of frame-like members having a pair of spaced side strips connected by end strips, with the side strips each having a pair of tracks or channels, with each track slidably receiving a slidable closure panel and the end strips having a track or channel for receiving an end closure panel. The open shelved units and the means for converting same to a closed cabinet are packed and shipped in a disassembled knock-down condition and readily assembled at the point of use without the use of any tools or extraneous fastening means.

8 Claims, 8 Drawing Figures

FIG. 6
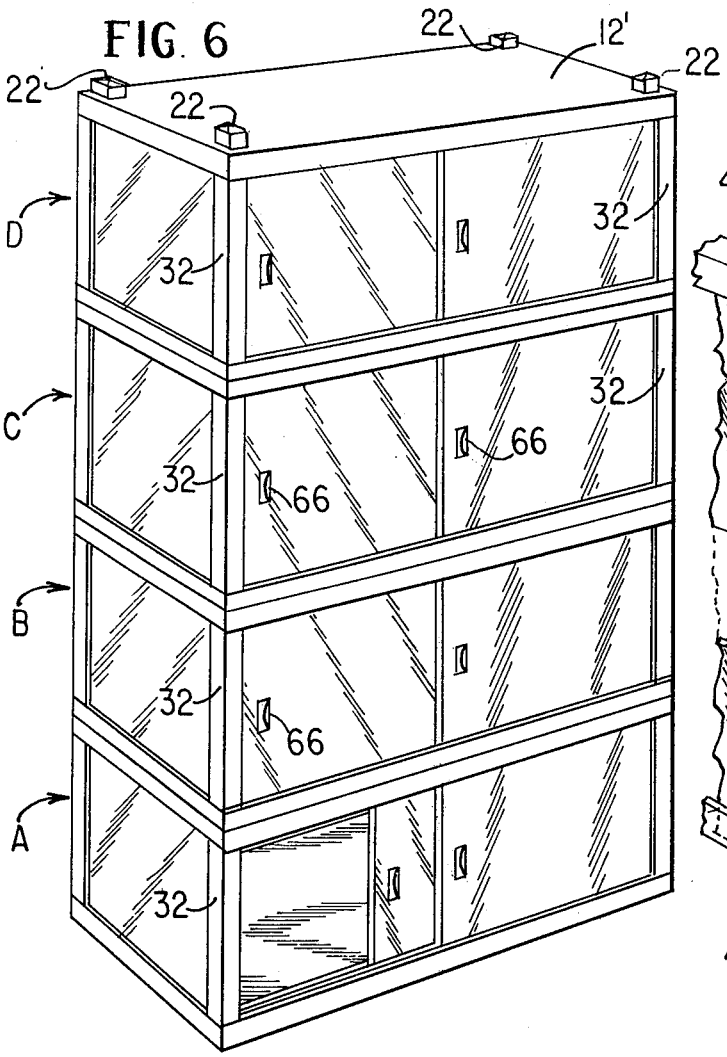
FIG. 4
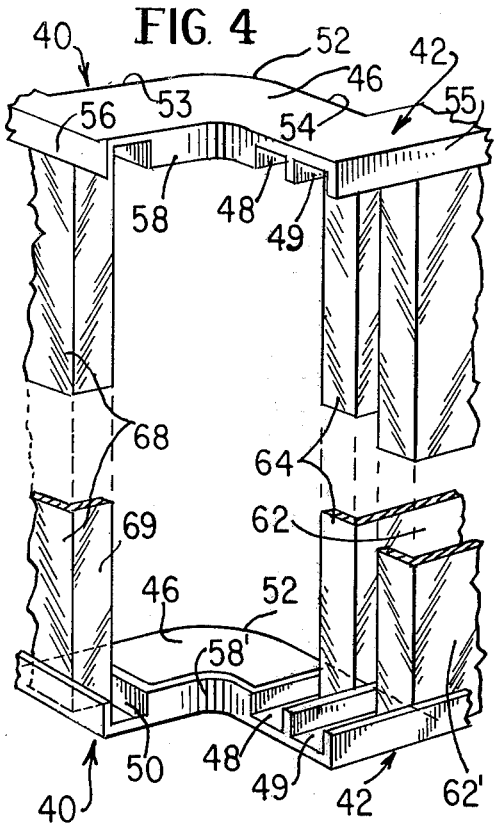
FIG. 7
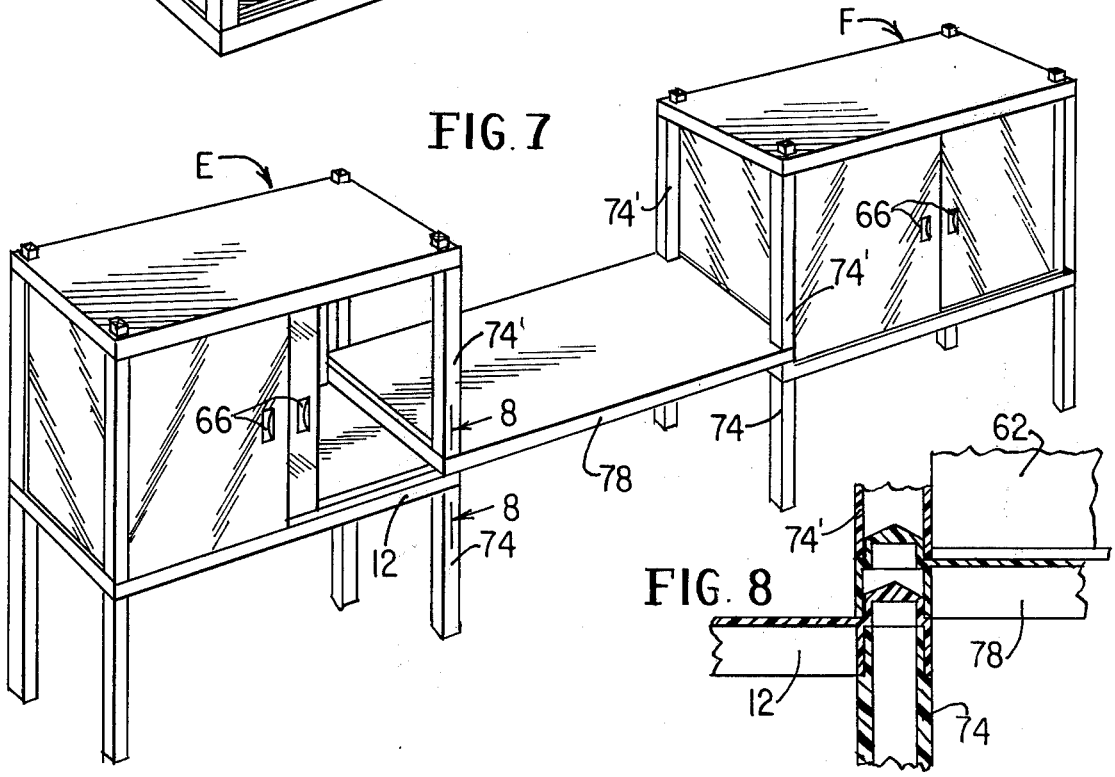
FIG. 8

MEANS FOR CONVERTING AN OPEN-SHELVED UNIT OR ETAGERE TO A CLOSED CABINET WITH SLIDABLE CLOSURE PANELS

BRIEF SUMMARY OF THE INVENTION

Open shelf units used either individually to form a two-shelved etagere or with a plurality of such units stacked and interlocked with each other in the form of a tier or the like are old and well-known in the art. Such units are open at the sides and ends and serve as shelves for placing various objects. These units are particularly of a decorative character and are used principally in the home, but not limited thereto.

An object of this invention is to provide such a unit or units with members which include preformed channels, trackways or grooves, which members are placed on the bottom shelf and another like member placed on the underside of the top shelf, inverted in respect to the bottom member, and providing closure members which are slidable in the trackways formed in the sides, and also end panels which fit within the end trackway or channel so that the open shelved unit is readily converted to an enclosed cabinet with slidable side panels and end panels.

Another object of this invention is to form the members which form the trackways for the panels of plastic material and of identical construction so that they can be molded in the same or identical mold cavity and wherein same can be readily secured to the open shelved units to support the closure panels.

Another object of this invention is to provide a structure of the foregoing character in which the open shelved unit or etagere and the means for converting same to a closed cabinet are packed and shipped in a knock-down condition and may be readily assembled by the user without the use of any tools and extraneous fastening elements, the same being capable of being readily set up for use either as an individual unit or as a tier of units or combination of tiers to form any desired arrangement.

Another object of this invention is to provide a structure of the foregoing character which may be economically manufactured of plastic material and requiring a minimum number of mold cavities and which is readily assembled and disassembled by the user.

BRIEF DESCRIPTION OF THE DRAWINGS

In the drawings:

FIG. 4 is a view, broken away partly in section, showing particularly the corners of the frame-like members which form the upper and lower trackways, with the side and end closure panels therebetween.

FIG. 6 is a view showing a plurality of units as shown in FIG. 1 stacked to form a tier of cabinet units.

FIG. 7 is a view showing a plurality of units arranged to form another arrangement; and FIG. 8 is a sectional view taken on line 8—8 of FIG. 7.

FIG. 1 shows one of the units disassembled and in an exploded view, and same comprises a bottom member 12 and a top member 12', both of which are of identical construction and molded in the same mold cavity and made of plastic. Since both of said members are identical, only one will be described in detail. Said member, whether it be the bottom or the top, is of generally rectangular shape and comprises a horizontal wall 16 with downwardly depending spaced sides 18 and downwardly depending ends 19 connected to said sides 18 to form a continuous flanged surface. Formed adjacent each of the four corners 20 and extending upwardly of the horizontal wall 16 is a square-shaped extension generally indicated at 22, the two outermost adjacent sides 23 and 24 of which are positioned slightly inwardly of the side and end walls 18 and 19 so that the wall 16 forms right-angled shoulders 26 and 27 at said extension. The top of said extension 22 is closed by a top wall 28 having a pyramidal shape for ornamental purposes. Extending downwardly at each of the corners is a square-shaped socket generally indicated at 29 (best shown in FIG. 5) with the innermost portion of said socket being of a reduced dimension to provide a continuous shoulder 30 in the interior of said socket.

Figures 1, 2, 3, 5:
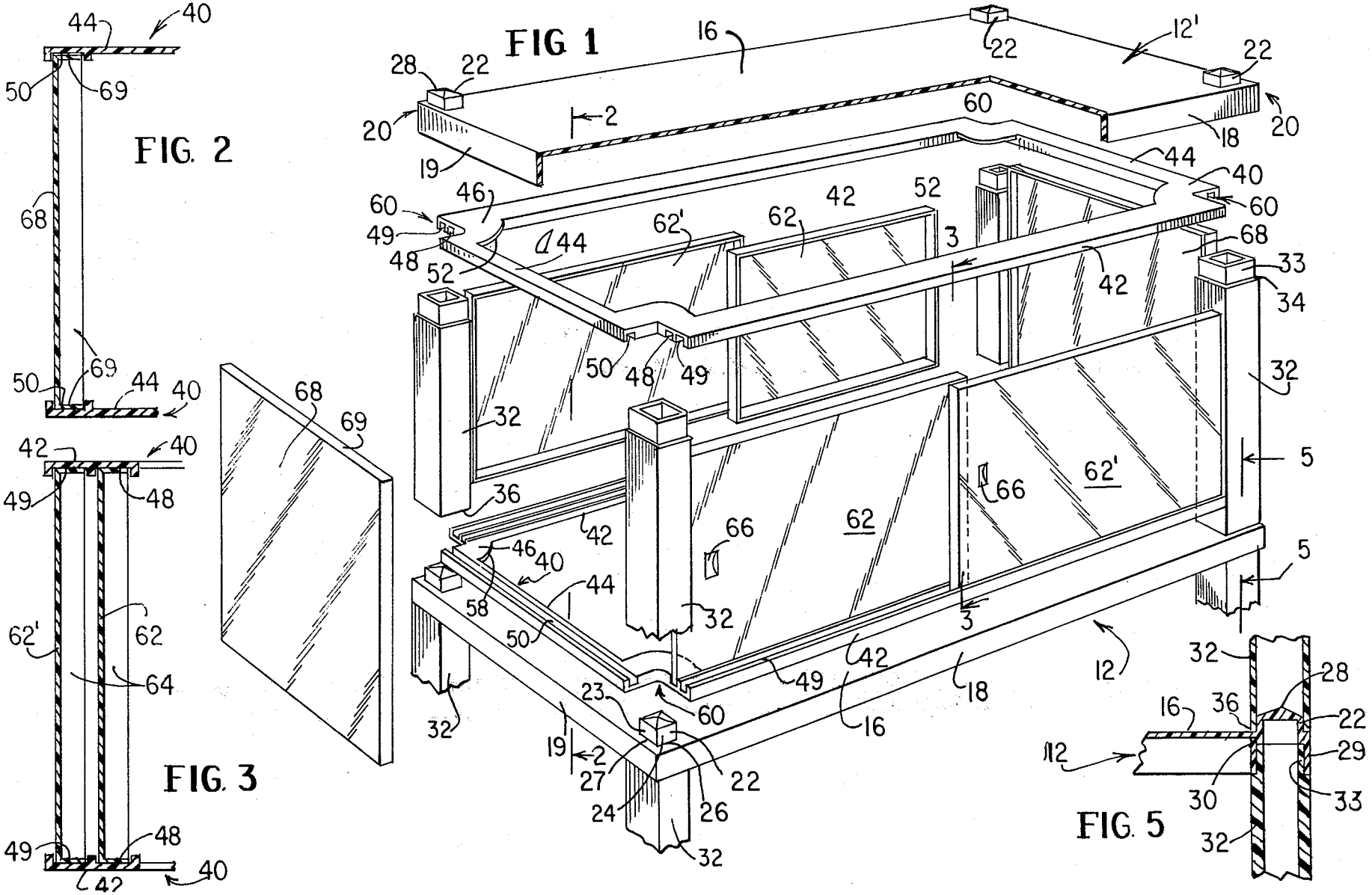
FIG. 1 is an exploded view showing a single unit and the parts disassembled for converting an open shelved unit or etagere to a closed cabinet which includes slidable closure panels on the opposite sides forming the front and rear of the cabinet, and stationary end closure panels.
FIG. 2 is a sectional view taken on line 2—2 of FIG. 1 showing the ends of the frame-like members when in assembled relation with the end closure panels therebetween.
FIG. 3 is a sectional view taken on line 3—3 of FIG. 1 showing the sides of the frame-like members when in assembled relation with the side slidable closures therebetween.
FIG. 5 is a sectional view taken on line 5—5 of FIG. 1.

The top and bottom members 12 and 12' are identical and are integrally formed and molded of a plastic material and are molded in the same or identical mold cavity. Two of said members are used for forming a single unit whereas a number of such members are used when forming a tier of such units of any height, as shown in FIG. 6. To complete the framework of a unit there are four tubular upright members each generally indicated at 32 formed of plastic material and all are formed in the same or similar mold cavity. Said tubular upright members 32 are square-shaped in cross-section with the opposite ends open. The upper portion of each upright has an end section 33 of reduced dimension which is also square-shaped in cross-section and provides a shoulder 34.

To connect the top and bottom members 12 and 12', best seen in FIG. 5, the open ended bottom 36 of the tubular upright member 32 is slipped on the extension 22 of the bottom member 12, with the end of said tubular upright member 32 abutting against the shoulders 26 and 27. The reduced extension 33 at the top of said upright is inserted into the square-shaped socket 29 of the top member 12' (also seen in FIG. 5) until the end of said reduced extension abuts against the inside shoulder 30 of said socket. With the top and bottom members 12 and 12' and with the four upright members 32 thus secured to said top and bottom members a single open shelved unit is formed, the parts being held together by frictional contact without the use of any extraneous fastening means. Each of these units, sometimes herein referred to as a "framework" or "open shelved unit" is in fact an open shelved unit or etagere due to the fact that the opposite sides and opposite ends are open and the top and bottom horizontal members 12 and 12' may each be used as a shelf on which objects are supported.

To convert the open shelf unit or units described into closed cabinet units there is provided for each of said units a pair of identical generally rectangular-shaped frame-like members, generally indicated at 40, which are molded of plastic material in the same or identical mold cavity. Each frame-like member 40 consists of a pair of spaced side strips 42 connected to spaced end strips 44 by a connecting piece 46. The side strips 42 are each formed with two channels or two trackways 48 and 49 and the end strips 44 are each formed with a single channel or groove 50. The connecting piece 46 has a generally arcuate shape in plan view with a curved inner edge 52. The outer edges 53 and 54 of the connecting piece 46 are at substantially right angles to each other and are planar with the end edges 55 and 56 of the side and end strips 42 and 44. The outer edges 53 and 54 have a flange 58 which is of the same height as the vertical walls forming the channels 48, 49 and 50.

As will be seen best in FIGS. 1 and 4, each of the four corners of said frame-like members 49 is cut out or recessed inwardly as at 60 to form a right-angled recessed corner at each corner so that when the frame-like member is positioned on the bottom member 12 the cutout or recessed corners 60 are positioned adjacent their respective uprights 32. This properly positions the frame-like member 40. As can best be seen in FIG. 1, the frame-like member 40 which is positioned on the bottom horizontal shelf member 12 has the trackways or grooves facing upwardly. When the same frame-like member 40 is positioned on the underside of the top horizontal shelf member the trackways or grooves face downwardly. The two frame-like members 40 which are identical and molded in the same mold cavity are positioned in the unit so that one is inverted in respect to the other.

Each side trackway 48 and 49 supports a single slidable closure panel 62, said panels being of identical construction, thus, the outer trackway 49 in the side strip 42 supports a sliding panel 62 and the inner trackway 48 of said side strip supports another identical panel 62'. The slidable panels 62 and 62' are made of plastic and are molded in the same or identical mold cavity. Each panel is of generally rectangular shape having an inwardly extending continuous flange 64 along the top, bottom and opposite sides. The said top and bottom flanges of said closure panels are positioned within the channels or trackways 48 and 49 of the top and bottom framelike members 40. Each closure or panel 62 and 62' is slightly longer than one-half the length of the unit so that when slid away from each other, as shown in the front of FIG. 1, they form a closure for the front and rear of the otherwise open unit.

The front wall of each of the closure panels 62 and 62' is recessed as at 66 so that the fingers of the hand may be positioned therein for the purpose of sliding said panels along the length of said unit. Two panels are positioned on each side and they may be slid relative to each other so as to open or close the sides of the unit. The sides of the unit in effect form the front and back of the unit. The opposite ends of the unit are closed by a stationary closure end panel 68 of rectangular shape which likewise has a continuous inwardly extending border flange 69, the top and bottom of which is received within the top and bottom grooves or channels 50 of the top and bottom frame-like members 40. The end closure panels 68 are both of the same construction and may be molded in the same or identical mold cavity.

Before the parts are attached to each other to form the open framework of the unit, the frame-like members 40 are positioned on top of the bottom shelf 12 and on the underside in inverted position of the top shelf 12' and the slidable side closure panel members 62 and 62' are inserted in their respective tracks, with the end closure panels 68 likewise being inserted and then the parts are assembled by interfitting the parts, as previously described. When thus interfitted the frame-like member 40 positioned against the underside of the top shelf will remain in position against the horizontal wall thereof by reason of the end and slidable closure panels, which will hold the upper frame-like member 40 in its proper position against the underside of the wall of the top member 12'. The four recessed cutouts 60 of each of the frame-like members 40 abut against the four uprights 32 and maintain the frame-like members in fixed position against movement. The slidable side panels and the end panels may be made to be either transparent, translucent or opaque.

While the foregoing is described in connection with a single framework or a single open shelved unit, it will be understood that a plurality of such units, each convertible to a cabinet unit in accordance with this invention may be interlocked to form a tier of such cabinets, as shown in FIG. 6, and such tiers may be readily assembled and disassembled. The cabinets of the tier, all of which are identical, are identified by the letters A, B, C and D for the purpose of illustration. For example, cabinet B is interlocked with bottom cabinet A by positioning the sockets 29 of cabinet B on the extension 22 of cabinet A. Cabinets C and D are likewise secured in the same tier.

FIGS. 7 and 8 show this invention in relation to units spaced from each other but connected by a connecting shelf. In this arrangement each of the cabinet units E and F are formed as previously described, except that the inner upper uprights designated at 74' are shorter than the previously described uprights 32 or the bottom uprights 74 but they are identical thereto. The bottom uprights 74 are of the same height as uprights 32. The connecting shelf 78 is similar to the top and bottom members 12 and 12' previously described which have corner extensions like 22 extending upwardly thereof and corner sockets like sockets 29. In connecting the connecting shelf 78 the bottom upright 74 is secured to the corner socket of bottom horizontal member 12. The corner socket of connecting shelf 78 is secured to the corner extension 22 of horizontal member 12. The open bottom of upright 74' is positioned on the extension similar to extension 22 on connecting shelf 78, all as best seen in FIG. 8, to detachably connect the parts together.

What is claimed is:

1. Means for converting an open-shelved unit to a closed cabinet with closure panels, with said open-shelved unit comprising a bottom horizontal wall member, a top horizontal wall member, each said horizontal wall member having a downwardly facing socket and an upwardly extending member adjacent the corners thereof for detachably receiving a tubular upright whereby the upper end of said uprights are interfitted with the downwardly facing socket of the top horizontal wall member and the upwardly extending members of the bottom horizontal wall member are interfitted with the bottom of the tubular upright adjacent said corners to thereby space said top and bottom horizontal wall members and connect same without the use of extraneous fastening elements, the upper end of said uprights having a shoulder; the means for converting said open-shelved unit to a closed cabinet comprising a pair of frame-like members, each said frame-like member comprising a pair of spaced side strips and a pair of spaced end strips all connected to form an integral unit, said frame-like members having a recess at each of its corners, one of said frame-like members positioned to rest on the bottom horizontal wall member and forming the bottom frame-like member and the other positioned against the underside of the top horizontal wall member and inverted in respect to the bottom frame-like member and forming the top frame-like member, said top and bottom frame-like members when thus positioned having their respective recessed corners positioned adjacent each respective upright so that the upper frame-like member rests on the shoulder at the upper end of said upright to secure said upper frame-like member in locked position relative to said uprights and with said bottom frame-like member retained in position relative to said uprights, said side strips of said frame-like members having a pair of side channels and said end strips each having an end channel, a closure panel slidably received in said side channels and a closure panel received in said end channels.

2. A structure as set forth in claim 1, in which the downwardly facing socket and the upwardly extending member adjacent each corner of said horizontal wall member are vertically aligned.

3. A structure as set forth in claim 2, in which the upper end of the tubular upright is of a reduced dimension to provide the shoulder, with said reduced upper end frictionally fitting within the downwardly facing socket and in which the upwardly extending member is of a reduced dimension to frictionally fit within the bottom of the tubular upright.

4. A structure as set forth in claim 1 in which the framelike member is integrally molded of plastic material in the same or identical mold cavity and may be used interchangeably.

5. A structure as set forth in claim 1 in which the closure panels are molded of plastic and each panel has upper and lower flanges which are received in the channels.

6. A structure as set forth in claim 5 in which the side panels are formed in the same or similar mold cavity and are interchangeable and in which the end panels are formed in the same or similar mold cavity and are interchangeable.

7. A structure as set forth in claim 1 in which a plurality of such units are positioned one above the other and detachably interlocked to form a tier of same.

8. A structure as set forth in claim 1 in which a plurality of such cabinets are formed and are spaced laterally from each other with a connecting horizontal shelf member therebetween.

* * * * *